United States Patent [19]

Seymour

[11] Patent Number: 4,513,938

[45] Date of Patent: Apr. 30, 1985

[54] RETRACTING REFUSE CAN SUPPORT

[76] Inventor: Charles M. Seymour, 1581 Oak Rd., Simi, Calif. 93063

[21] Appl. No.: 297,248

[22] Filed: Aug. 28, 1981

[51] Int. Cl.[3] ..... A47B 97/00

[52] U.S. Cl. ..... 248/507; 248/DIG. 7; 211/85; 211/1.3; 211/196; 403/109; 403/379; 52/40; 52/118; 52/632

[58] Field of Search ..... 248/509, 507, DIG. 7, 248/154, 150, 156, 359, 552, 553; 211/85, 1.3, 196, 71, 78; 403/103, 109, 379; 52/40, 118, 110, 301, 721

[56] References Cited

U.S. PATENT DOCUMENTS

| | | | |
|---|---|---|---|
| 951,007 | 3/1910 | Kirkpatrick | 248/507 X |
| 2,142,647 | 1/1939 | Heller | 248/150 |
| 2,971,739 | 2/1961 | Kirkland | 248/DIG. 7 |
| 3,053,495 | 9/1962 | Schmier | 248/DIG. 7 |
| 3,527,355 | 9/1970 | Boyer | 211/71 |
| 3,642,145 | 2/1972 | Shelton | 211/85 X |
| 4,172,913 | 10/1979 | Ballah et al. | 403/109 X |
| 4,206,847 | 6/1980 | Brink | 211/1.3 |
| 4,225,048 | 9/1980 | Hildreth | 211/196 X |
| 4,257,544 | 3/1981 | Dierkes | 248/553 X |

*Primary Examiner*—Ramon S. Britts
*Assistant Examiner*—Blair M. Johnson
*Attorney, Agent, or Firm*—Poms, Smith, Lande & Rose

[57] ABSTRACT

A retractable apparatus for holding garbage or refuse cans in an erect position includes a hollow casing implanted in the ground, a telescoping support column contained in the casing, and a head fixture attached to the support column for receiving and securing blade extensions attached to refuse cans. The casing is buried so that its upper end is substantially flush with ground level. The support column is retracted, when not in use, to a storage position contained within the hollow casing, by collapsing a number of telescopically interconnected elements which make up the support column. A recess is provided at the top of the inner surface of the hollow casing to receive and contain the head fixture in a position substantially flush with ground level. To secure refuse cans in an upright position, the support column is telescopically extended to an above-ground position. Blade extensions attached to the refuse cans are then inserted into receiving slots in the now-elevated head fixture. Locking pins are inserted through corresponding holes in the head fixture and blade extensions to secure the refuse cans to the support column. Internal friction brakes are provided at each telescopically interconnected element of the support column to hold the elements in position when extended above ground.

11 Claims, 4 Drawing Figures

RETRACTING REFUSE CAN SUPPORT

FIELD OF THE INVENTION

This invention relates to refuse or garbage disposal arrangements, and more specifically to arrangements for avoiding undesired dispersal of refuse or garbage.

BACKGROUND OF THE INVENTION

Up to the present time, overturned garbage or refuse cans have been known to pose a considerable problem to residential homeowners. Once the cans have been placed at curbside for refuse pickup, the homeowner has no convenient method available for maintaining the refuse cans in an upright position. Can stability is normally provided by the weight of the can and its contents; however, scavenging animals, accidental contact with bicycles and autmobiles, and even intentional acts of vandalism can upset the loaded refuse cans. Once emptied, the stability provided by the weight of the contents is absent, making the can even easier to upset. Today's lightweight plastic refuse cans amplify this problem. Residential areas prone to windy conditions pose an additional problem in terms of can stability, as empty refuse cans may be blown over and rolled a considerable distance by the wind.

Permanent and portable above-ground structures are effective in combating the problems of trash can instability. However, in addition to being relatively expensive and inconvenient to use, such structures are exposed to weathering by the elements.

Accordingly, a principal object of the present invention is to provide a lightweight and inexpensive support apparatus which may be employed at curbside to hold garbage or refuse cans in a stable erect position, yet may be stored conveniently and unobtrusively below curbside ground level when not in use.

Another object of the present invention is to provide an apparatus which is relatively simple and convenient to use.

A further object of the present invention is to provide a support apparatus that is resistant to damage by the elements and therefore virtually maintenance free.

SUMMARY OF THE INVENTION

The present invention provides a new and improved refuse can support apparatus which is inexpensive to manufacture, and reliable in use. Moreover, the present invention provides a support apparatus that can be retracted into a flush, ground-level casing when not in use.

More specifically, in accordance with a broad structural aspect of the present invention, the apparatus includes a hollow outer casing implanted in the ground so that its upper portion is substantially flush with ground level. Contained within this casing, is a support column that can be extended above ground level for use, and retracted into the casing for storage. Attached to the top of the support column is a head fixture to which a number of refuse cans can be attached and held in a stable upright position.

In one specific arrangement, with the support column raised, a horizontal blade extension mounted near the top of each refuse can is inserted into one of a number of horizontal slots in the head fixture. A removable locking pin is then inserted through corresponding holes in the head fixture and blade extension to lock the blade within the slot. Stops may be provided near the top of the locking pin to prevent it from passing completely through the blade and head fixture. In this manner, refuse cans, either loaded or empty, are secured in an upright position.

In an alternative embodiment of the present invention, the locking pin is provided with a horizontally elongated flange near its lower end. Holes, corresponding in shape to the shape of the flange, are provided in both the head fixture and blade extension. Thus, after inserting the locking pin through the holes, the locking pin can be further secured in position by a ninety degree rotation about its vertical axis to position the elongated flange out of alignment with the elongated holes. In this manner, the locking pin can be used as a detachable handle for raising the support column.

In accordance with another feature of the present invention, the support column includes a number of telescopically collapsible interconnected elements; enabling the support column to be collapsed into the below-ground casing for convenient, out-of-the-way storage. Conversely, when necessary to support refuse cans, the support column can be telescopically extended above ground for use. To provide for the light weight and inexpensive manufacture of the present invention, and to provide maintenance free operation and resistance to the elements, the interconnected elements of the support column are preferrably made of inexpensive commercially available PVC tubing.

It is a particular feature of the present invention that the interconnected elements of the support column are provided with O-ring friction brakes to maintain their position of the elements relative to one another along the range of telescopic extent of the support column. The O-rings are mounted on shoulders formed near the bottom ends of each element; and extend radially outward beyond their respective shoulders to frictionally engage the interior surface of the next successively larger tubular element.

The hollow casing, buried substantially flush with ground level, preferably is made of concrete or heavy-duty plastic pipe. A recess is formed at the top of the inner casing surface to receive and contain the head fixture in a position substantially flush with ground level when the support column is retracted into the casing.

Other features and advantage of the present invention will become apparent from a consideration of the following detailed description, taken in conjunction with the accompanying drawings.

DETAILED DESCRIPTION

Figure 1:
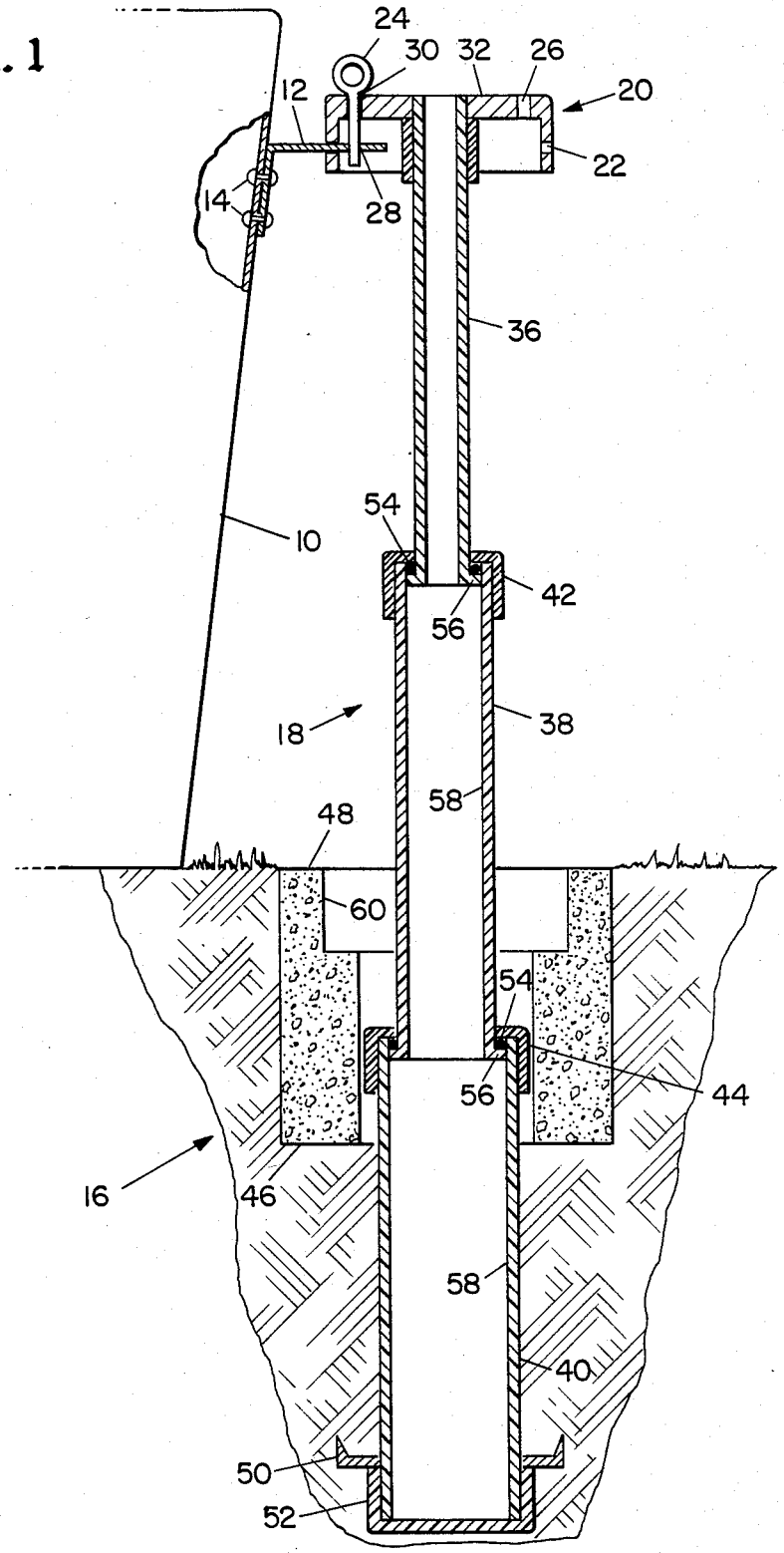
FIG. 1 is a partly-sectional view of a refuse can secured to a support apparatus illustrating the principles of the present invention.

Referring more particularly to the drawings, FIG. 1 is a partial-cross-sectional view showing a refuse can 10, to which a blade extension 12 has been securely fastened by bolts 14. Refuse can 10 is secured via blade extension 12 to a support apparatus 16 illustrating the principles of the present invention. The apparatus 16 includes a telescopically retractable support column 18 with a head fixture 20 securely attached to its upper end. Head fixture 20 is provided with a number of slots (two of which are shown), indicated by reference numeral 22, for receiving blade extension 12; thus, the apparatus 16 is capable of supporting a number of refuse cans 10 at any one time. Each slot 22 is perpendicularly intersected by one of a number of holes, indicated by reference numeral 26, provided in head fixture 20. By inserting a locking pin 24 through hole 26 and a correspondingly aligned hole 28 through blade extension 12, the blade extension 12 can be securely locked in position within slot 22 as shown in FIG. 1. Locking pin 24 is provided with stop 30 for engagement with the upper surface 32 of head fixture 20 to prevent locking pin 24 from passing completely through head fixture 20 and blade extension 12. Thus, refuse can 10 is securely attached to support apparatus 16 by positioning blade extension 12 within slot 22 and then inserting pin 24 through the now concentrically aligned holes 26 and 28. Removal of pin 24 will quickly release the refuse can 10 from the support apparatus 16.

It will be appreciated that refuse can 10 can be releasably secured to head fixture 20 in any desired manner, so long as the refuse can is firmly held in an upright position when secured to the support apparatus. Further, it is highly desirable to be able to attach and remove the can 10 to and from the support apparatus 16 quickly and easily. Toward this end, the presently preferred structure for releasably securing the can to the apparatus is by use of the blade extension 12, head fixture 20, and locking pin 24. Additionally, an alternative locking pin and head fixture arrangement is described in FIGS. 3 and 4.

Also visible in FIG. 1 are tubular elements 36, 38, and 40, which are telescopically interconnected by fittings 42 and 44 to form support column 18. Tubular element 40 is rigidly set below ground by an anchor ring 50 landed or mounted upon a tubular end cap 52. Accordingly, support column 18, composed of elements 36, 38, and 40, is firmly anchored at its base. Added stability for support column 18 is provided by a hollow casing 46 surrounding support column 18 and implanted in the ground so that the upper portion 48 of casing 46 is substantially flush with ground level. When telescopically extended to an above-ground position, tubular elements 36, 38, and 40, are held in position relative to one another by O-ring friction brakes, indicated by reference numeral 54, provided at the base of elements 36 and 38. Each O-ring brake 54 is landed upon and projects radially outward beyond a shoulder 56 formed at the base of its respective element, to frictionally engage the interior surface 58 of the next successively larger element.

Figure 2:
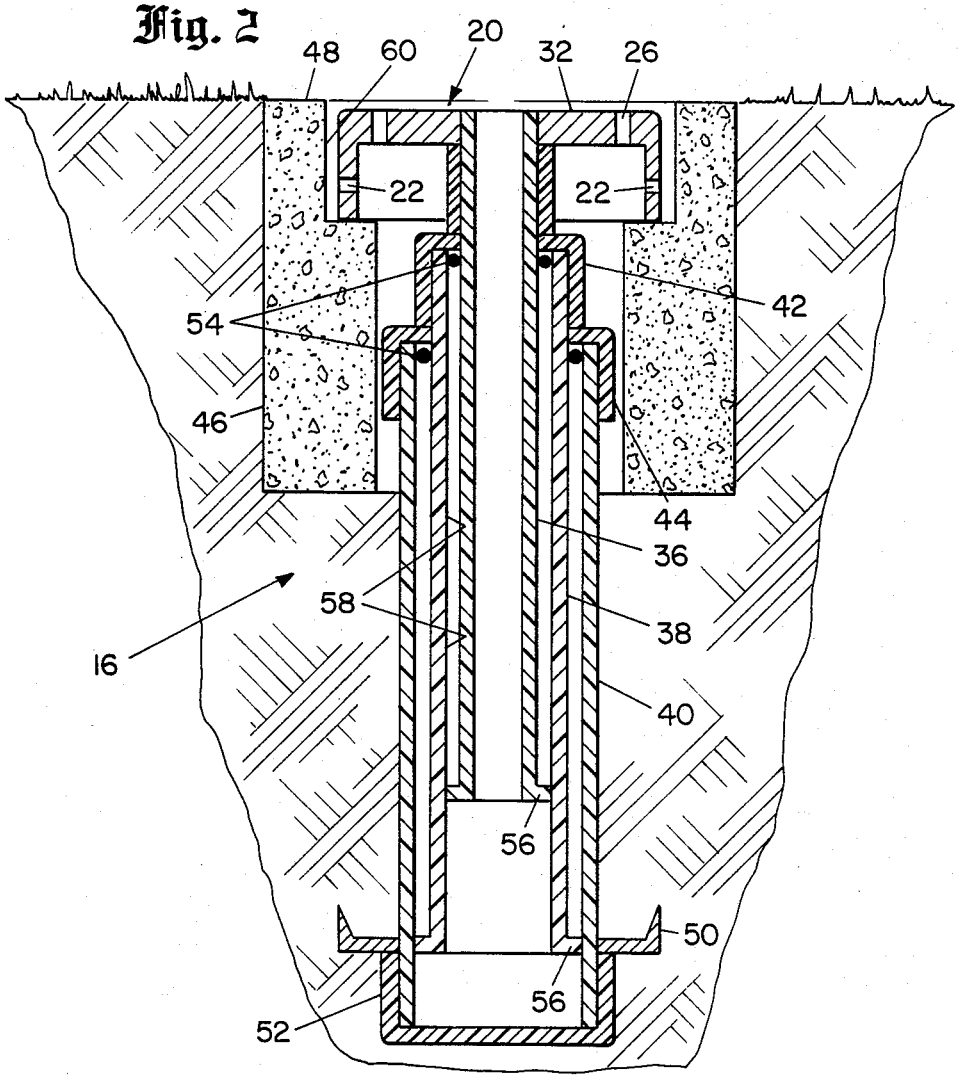
FIG. 2 is an enlarged, sectional view of a telescoping refuse can support apparatus of FIG. 1 shown in the lowered or stored configurations.

FIG. 2 is an enlarged cross-sectional view of a retracting refuse can support apparatus 16 shown in the retracted storage mode with tubular elements 36, 38, and 40 telescopically collapsed to position the upper surface 32 of head fixture 20 substantially flush with the upper portion 48 of hollow casing 46 at ground level. The internal surface of hollow casing 46 is recessed, as indicated at 60, to receive head fixture 20 when the elements 36, 38, and 40 of support column 18 are telescopically collapsed to retract support column 18 into the hollow casing 46. Accordingly, the present invention provides a refuse can support apparatus that is conveniently stored, when not in use, by retracting the apparatus into a casing flush with the ground level.

It is to be noted that the elements 36, 38 and 40, and fittings 42 and 44, are preferrably made of commercially available plastic tubing. The hollow casing 46, as shown in the presently preferred embodiment, is made of cast concrete; however, heavy-duty plastic pipe can be used in place of concrete. These construction materials provide the added desirable features of strong, lightweight, low-cost construction combined with weather resistance and minimal maintenance requirements.

Figure 3:
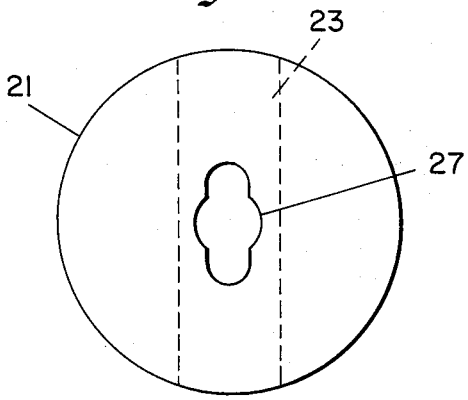
FIG. 3 is a top view of an alternative head fixture which is employed to secure the refuse cans to the support apparatus as disclosed herein.
Figure 4:
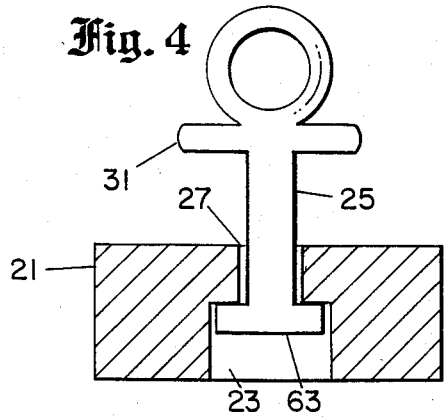
FIG. 4 is a cross-sectional view of the alternative head fixture of FIG. 3 and illustrates the shape of the alternative locking pin which is also employed to raise the support apparatus.

FIGS. 3 and 4 illustrate an alternative head fixture and locking pin arrangement of the present invention. In addition, the alternative locking pin of FIG. 4 is employed as a detachable handle for raising the support apparatus.

Referring now to FIG. 3, a top view of the alternative head fixture 21 is shown. A centrally located, elongated hole 27 passing through head fixture 21 is also visible. Transverse slot 23, shown ghosted in FIG. 3, perpendicularly intersects elongated hole 27 and is longitudinally aligned with the elongated extensions of hole 27.

FIG. 4, a cross-sectional view, shows the alternative head fixture 21 with elongated hole 27 perpendicularly intersecting slot 23. Alternative locking pin 25, shown inserted through hole 27, is provided with an elongated flange 63 at its base. Elongated flange 63, corresponding in shape to hole 27 (see FIG. 3) can be positioned out of alignment with the elongated portion of hole 27 by rotating pin 25 about its vertical axis. As shown in FIG. 4, when rotated out of alignment after insertion through hole 27, flange 63 lockingly engages the upper surface of slot 23. In this manner, pin 25 can be locked into hole 27 for use as a handle to raise and lower support column 18 (not shown). An enlarged stop 31 is provided at the top of pin 25 to facilitate the use of pin 25 as a handle. Rotating pin 25 to align the elongated flange 63 with the elongated hole 27 allows the Flange 63 to pass through the hole 27 for insertion and removal of pin 25.

Additionally, in the alternative embodiment, the hole 28 (not shown) passing through the blade extension 12 (not shown) is elongated to conform to the shape of elongated flange 63. Therefore, by utilizing the locking procedure described in FIG. 1, blade extension 12 can be secured within slot 23 by the insertion of pin 25 through head fixture 21 and blade extension 12. Again, pin 25 can be locked in position following insertion by rotating flange 63 out of alignment with the elongated holes. The central location of elongated hole 27 through head fixture 21 allows pin 25 to simultaneously secure two overlapping blade extensions, one blade inserted from each of end slot 23, by passing through the concentrically aligned holes. Thus, it is possible to secure as many as four refuse cans to the alternative head fixture with the single locking pin.

In closing, it is to be understood that the embodiments of the invention disclosed herein are illustrative of the principles of the invention. Other modifications may be employed which are within the scope of the invention; thus, by way of example and not of limitation, the support column 18 may be formed of two or more elements, other materials may be used, and alternative securing arrangements, such as hooks, straps, or other quickly releasable clamps, may be used to secure refuse cans to head fixtures 20 and 21. By way of example, one alternative arrangement for securing the refuse cans to the head fixture could utilize a heavy wire hook fixedly or pivotally secured to the refuse can, and extending vertically up or down into holes in the head fixture; or, the hook could be formed in the head fixture itself and extend vertically downward into the refuse cans. Also, the pins 24 and 25 may be secured to the head fixture. Accordingly, the invention is not limited to the particular arrangements which have been illustrated and described in detail herein.

What is claimed is:

1. A retractable apparatus for holding garbage or refuse cans in an erect position comprising:

hollow casing means for location in the ground and having an upper surface substantially flush with ground level;

support column means normally contained in said casing substantially flush with the upper surface of said casing means and with ground level, but extended to a firm upright position above ground;

means for releasably securing garbage or refuse cans to said support column means; whereby they are firmly held in an upright position and overturning by scavengers or the elements is precluded; and said means for releasably securing garbage or refuse to said support column means including at least one horizontally disposed and outwardly extending blade attached near the top of a garbage or refuse can, a head fixture secured to said support column means, said head fixture having at least one horizontally oriented slot for receiving said blade, and means for releasably locking said blade within said slot.

2. An apparatus as described in claim 1, wherein said means for releasably locking said blade comprises a surface defining a vertically oriented hole through said blade, said hole being positioned for concentric alignment with a corresponding surface defining a hole extending through said head fixture, and a removable locking pin for insertion through said hole in said head fixture and continuing through said hole in said blade, to lock said blade in position within said slot, said locking pin having a stop at its upper end for engaging the upper horizontal surface of said head fixture to prevent said pin from passing completely through said hole in said head fixture.

3. An apparatus as defined in claim 1, wherein said means for releasably locking said blade comprises a surface defining a vertically oriented, horizontally elongated hole through said blade, said hole being positioned for concentric alignment with a corresponding surface defining a similarly shaped elongated hole extending through said head fixture, and a removable locking pin for insertion through said elongated hole in said head fixture and continuing through said elongated hole in said blade, said pin having a stop at its upper end for engaging the upper horizontal surface of said head fixture to prevent said pin from passing completely through said head fixture, and having a horizontally elongated flange at its lower end, said flange corresponding in shape to the shape of said elongated holes to enable said pin to be secured in position after insertion through either of said elongated holes by rotating said pin about its vertical axis to position said elongated flange out of alignment with said correspondingly shaped elongated holes, precluding the passage of said elongated flange back through said holes.

4. A retractable apparatus for holding garbage or refuse cans in an erect position comprising:

hollow casing means for location in the ground and having an upper surface for mounting near ground level;

support column means normally substantially contained in said casing substantially flush with ground level, but extended to an upright position above ground;

means for releasably securing garbage or refuse cans to said support column means whereby they are firmly held in an upright position and over-turning by scavengers or the elements is precluded; and said means for releasably securing garbage or refuse cans to said support column means including at least one horizontally disposed and outwardly extending blade attached near the top of a garbage or refuse can, a head fixture secured to said support column means, said head fixture having at least one horizontally oriented opening for receiving said blade, and means for releasably holding said blade within said opening.

5. An apparatus as defined in claim 4, wherein said support column means includes a plurality of telescopically collapsible interconnected elements, said elements having friction-brake means for holding said elements in position relative to one another.

6. An apparatus as defined in claim 5, wherein said friction-brake means includes an outer surface defining a shoulder near the lower end of each of said telescopically collapsible interconnected elements, and a resilient O-ring landed on each of said shoulders, said O-rings each radially projecting beyond its respective shoulder to frictionally engage the interior surface of the next successively larger telescopically interconnected element.

7. An apparatus as defined in claim 5, wherein said telescopically collapsible interconnected elements are made of commercially available tubing.

8. An apparatus as defined in claim 7, wherein said commercially available tubing is PVC pipe.

9. An apparatus as defined in claim 1, wherein said hollow casing is made of concrete.

10. An apparatus as defined in claim 1, wherein said hollow casing is made of heavy duty PVC pipe.

11. An apparatus as defined in claim 4 further comprising laterally extending means secured to said casing for preventing easy removal of said casing from the ground, following installation.

* * * * *